US010492598B2

(12) United States Patent
Hadida

(10) Patent No.: US 10,492,598 B2
(45) Date of Patent: Dec. 3, 2019

(54) MOTORIZED EXTENDABLE TABLE

(71) Applicant: Isaac Hadida, Hallandale Beach, FL (US)

(72) Inventor: Isaac Hadida, Hallandale Beach, FL (US)

(73) Assignee: Hadida Worldwide Company, LLC., Aventura, FL (US)

( * ) Notice: Subject to any disclaimer, the term of this patent is extended or adjusted under 35 U.S.C. 154(b) by 0 days.

(21) Appl. No.: 16/179,391

(22) Filed: Nov. 2, 2018

(65) Prior Publication Data

US 2019/0320790 A1 Oct. 24, 2019

Related U.S. Application Data

(60) Provisional application No. 62/659,195, filed on Apr. 18, 2018.

(51) Int. Cl.
*A47B 1/05* (2006.01)
*A47B 1/10* (2006.01)

(52) U.S. Cl.
CPC ..... *A47B 1/05* (2013.01); *A47B 1/10* (2013.01); *A47B 2001/053* (2013.01); *A47B 2200/008* (2013.01)

(58) Field of Classification Search
CPC ..... A47B 1/05; A47B 1/10; A47B 2001/053
USPC ..... 108/65, 69, 70, 73, 83, 89, 87, 71, 72
See application file for complete search history.

(56) References Cited

U.S. PATENT DOCUMENTS

| | | | | |
|---|---|---|---|---|
| 687,712 | A | 12/1901 | Irwin | |
| 821,955 | A | 5/1906 | Nash | |
| 829,439 | A | 8/1906 | de Simone | |
| 993,539 | A | 5/1911 | Munz | |
| 1,302,420 | A * | 4/1919 | Nyholm | 108/67 |
| 1,411,114 | A * | 3/1922 | Lundquist | A47B 1/03 108/67 |
| 2,784,046 | A * | 3/1957 | Gipple | A47B 1/04 312/319.7 |
| 2,815,257 | A * | 12/1957 | Gariepy | A47B 1/02 108/83 |
| 4,201,816 | A | 5/1980 | Bertelsen | |
| 4,494,466 | A | 1/1985 | Synek et al. | |

(Continued)

FOREIGN PATENT DOCUMENTS

| | | |
|---|---|---|
| DE | 3603614 A1 | 8/1987 |
| EP | 1815767 A2 | 8/2007 |

(Continued)

*Primary Examiner* — Jose V Chen
(74) *Attorney, Agent, or Firm* — Albert Bordas, P.A.

(57) ABSTRACT

A motorized extendable table having a tabletop assembly, first and second extension assemblies, a frame assembly, first and second extension frame assemblies, a motor housing, a computer assembly, a motor assembly, and a base assembly. In operation, the motor assembly moves the extension frame assemblies from a retracted to an extended configuration. Before reaching a fully extended configuration, the extension assemblies are raised to a same plane as that of the tabletop assembly. To go from the extended to the retracted configuration, the motor assembly moves the system in an opposite direction, moving the extension frame assemblies down and back onto a lower plane. Extension frame assemblies continue moving back until the fully retracted configuration is reached.

17 Claims, 6 Drawing Sheets

(56) References Cited

U.S. PATENT DOCUMENTS

| | | | | |
|---|---|---|---|---|
| 4,794,869 | A | 1/1989 | Chiu | |
| 5,031,975 | A * | 7/1991 | Anderson | A47B 77/10 108/20 |
| 5,156,095 | A | 10/1992 | Hansbaek et al. | |
| 5,224,429 | A * | 7/1993 | Borgman | A47B 9/00 108/147 |
| 5,237,937 | A | 8/1993 | Peltier et al. | |
| 5,806,437 | A * | 9/1998 | Huang | A47B 1/02 108/86 |
| 6,009,814 | A | 1/2000 | Rossi | |
| 6,286,441 | B1 * | 9/2001 | Burdi | A47B 9/00 108/147 |
| 6,352,037 | B1 * | 3/2002 | Doyle | A47B 9/00 108/147 |
| 6,443,073 | B1 | 9/2002 | Tsang et al. | |
| 6,595,144 | B1 * | 7/2003 | Doyle | A47B 9/00 108/147 |
| 6,742,461 | B1 | 6/2004 | Sen | |
| 7,464,653 | B2 | 12/2008 | Dodge | |
| 8,365,678 | B2 | 2/2013 | Morbidelli | |
| 8,550,011 | B2 * | 10/2013 | Lee | A47B 1/03 108/86 |
| 8,947,215 | B2 * | 2/2015 | Mandel | G06Q 10/109 108/147 |
| 9,675,169 | B1 | 6/2017 | Lai et al. | |
| 9,907,393 | B2 | 3/2018 | Rossi | |
| 9,924,791 | B2 | 3/2018 | Bortolato et al. | |
| 9,999,971 | B2 * | 6/2018 | Charlton | B25H 1/16 |
| 2002/0195028 | A1 * | 12/2002 | Shieh | B23D 47/025 108/69 |
| 2004/0194672 | A1 | 10/2004 | Conley et al. | |
| 2006/0032415 | A1 | 2/2006 | Wang | |
| 2006/0075940 | A1 | 4/2006 | Dodge | |
| 2011/0247529 | A1 * | 10/2011 | Morbidelli | A47B 1/05 108/50.11 |
| 2017/0127820 | A1 | 5/2017 | Bortolato et al. | |

FOREIGN PATENT DOCUMENTS

| | | | |
|---|---|---|---|
| FR | 2734133 | A1 | 11/1996 |
| WO | 2016005881 | A1 | 1/2016 |

* cited by examiner

MOTORIZED EXTENDABLE TABLE

OTHER RELATED APPLICATIONS

The present application claims priority of U.S. Provisional Application No. 62/659,195, filed on Apr. 18, 2018, which is hereby incorporated by reference.

BACKGROUND OF THE INVENTION

Field of the Invention

The present invention relates to extendable tables, and more particularly, to a motorized extendable table that can be operable with a remote control.

Description of the Related Art

Applicant believes that one of the closest references corresponds to U.S. Pat. No. 687,712 A issued to May Irwin on Dec. 3, 1901 for Extension table. However, it differs from the present invention because Irwin teaches an extension table consisting of four separate triangular sections.

Applicant believes that another reference corresponds to U.S. Pat. No. 821,955 issued to Carl Enos Nash on May 29, 1906 for Extension-Table. However, it differs from the present invention because Nash teaches an extension-table that provides round tables, which may be set to two or more sizes and yet retain the perfect round contour top in all sizes.

Applicant believes that another reference corresponds to U.S. Pat. No. 829,439 issued to Guglielmo de Simone on Aug. 28, 1906 for Expanding table. However, it differs from the present invention because Simone teaches an expanding table that provides means whereby a table of circular shape can be readily expanded with considerable increase of real and sitting capacity and without dividing or unfolding the normal or closed tabletop and still retaining the circular shape.

Applicant believes that another reference corresponds to U.S. Pat. No. 993,539 issued to Charles Munz on May 30, 1911 for Round-top extension-table. However, it differs from the present invention because Munz teaches a round-top extension table that consists in the construction of the extension leaves and the means for supporting and storing the same.

Applicant believes that another reference corresponds to U.S. Pat. No. 4,201,816 issued to Henry F. Bertelsen on May 6, 1980 for Basis for tabletop for an extension table. However, it differs from the present invention because Bertelsen teaches basis for a tabletop for an extension table having extension leaves with extension bars. The tabletop basis consists of three laminae having the same thickness and placed one on top of the other and are provided with various cut-out areas and slanting zones which together constitute cavities for slidably receiving extension bars of the extension leaves of the table.

Applicant believes that another reference corresponds to U.S. Pat. No. 4,494,466 issued to Synek, et al. on Jan. 22, 1985 for Table with a mechanism for automatically varying the size of the tabletop. However, it differs from the present invention because Synek, et al. teach a table having a pair of side leaves movable with respect to each other to abut each other for forming a small tabletop, a center leaf selectively interposable between the pair of side leaves for forming a large tabletop, and a moving mechanism for selectively automatically configuring the leaves into a small or a large tabletop. The moving mechanism includes an apparatus for sliding the side leaves toward and away from each other, a cam apparatus for raising and lowering the center leaf and for storing the center leaf below the side leaves and for retrieving the center leaf from storage, and a driving apparatus for moving the slide apparatus and the cam apparatus.

Applicant believes that another reference corresponds to U.S. Pat. No. 4,794,869 issued to Jack Chiu on Jan. 3, 1989 for Structure of extendable tables. However, it differs from the present invention because Chiu teaches a table comprising two semi-elliptical plates, table legs, two posts, and an engaging plate formed of a first plate and a second plate hinged together. Several protrusions are disposed at either side of the engaging plate and a side plate is arranged on each of the two posts. At both ends of the side plates are connected with two rails. Thus, a rotating space is formed between the side plates and rails such that the engaging plate can either be positioned between two semi-elliptical plates to form a larger table or it can be concealed within the rotating space to form a smaller table.

Applicant believes that another reference corresponds to U.S. Pat. No. 5,156,095 issued to Hansbaek, et al. on Oct. 20, 1992 for Table having additional extendible and retractable leaves. However, it differs from the present invention because Hansbaek, et al. teach a table having table leaves displaceable between a first position, in which the table area is relatively small, and a second position, in which the table area is relatively large by insertion of additional leaves. The table leaves are radially displaceable from a first position in which they abut one another substantially along radial planes extending from the central axis. The additional leaves are mutually defined and hingedly interconnected along rims extending in the second position of the table leaves substantially along straight lines between innermost points of each table leaf and the innermost point of the adjacent table leaf. A storing chamber is situated centrally below the table in a centrally situated supporting column for the storing of the additional leaves when the table is not extended.

Applicant believes that another reference corresponds to U.S. Pat. No. 5,237,937 issued to Peltier, et al. on Aug. 24, 1993 for Expansible table. However, it differs from the present invention because Peltier, et al. teach an expansible table that includes a round tabletop formed of four equal sectors or quadrants for sliding movements on tracks between retracted and extended positions which permits the insertion of inserts or leaves to enlarge the size of the table. Guide pins downwardly extending from each sector are captured in associated spiral slots of a rotatably mounted platform or plate, so that rotation of the slotted plate facilitates simultaneous movement of all the sectors to the desired positions. Such expansion and contraction of the table can be accomplished by one individual in an effortless and a convenient manner.

Applicant believes that another reference corresponds to U.S. Pat. No. 6,009,814 issued to Luis Rossi on Jan. 4, 2000 for Expandable table. However, it differs from the present invention because Rossi teaches an expandable table, comprising a tabletop layer, a guide layer, an actuation layer, a central axis, and a base. The tabletop layer comprises a plurality of segments, each having a pair of segment sides, which meet at a segment point. When the tabletop is in the retracted position, all segment sides correspond with segment sides of adjacent segments, and the segment points meet at the central axis of the table. The guide layer comprises a plurality of radial guide slots, which equal in number the number of segments. The actuation layer comprises a plurality of arcuate slots which equal the guide slots and which spiral outward from and around the center. A vertical rod extends downward from each of the segments and engages one of the radial guide slots and one of the arcuate actuating slots. The position of each segment is thus at all times defined by the relative position of its associated guide slot and actuating slot. The guide layer and actuation layer are capable of relative rotary motion about the central axis to alter the relative position of the guide slots and actuating slots, and thus cause the segments to move radially inward or radially outward. Once the segments have been moved fully radially outward, leaves may be inserted between the segment sides to create an even, expanded tabletop surface.

Applicant believes that another reference corresponds to U.S. Pat. No. 6,443,073 issued to Tsang, et al. on Sep. 3, 2002 for Extendable table. However, it differs from the present invention because Tsang, et al. teach an extendable table having a pair of main top panels and a pair of extension top panels that are stowable under the main panels. The main panels are secured to sliding frames, which are slidably movable relative to a fixed table frame. Each extension panel is seated on one sliding frame. As the main panel is pulled outwardly, the associated extension panel is automatically lifted up into the gap opened above the table frame, by interaction of guide means on the undersurface of the extension panel with the sliding frame and the fixed frame.

Applicant believes that another reference corresponds to U.S. Pat. No. 6,742,461 issued to Lor Lean Sen on Jun. 1, 2004 for Extensible table. However, it differs from the present invention because Sen teaches an extensible table with its unextended tabletop formed by leaves that are slidably fixed on the supporting frame of the table. The sliding leaves are moved away from each other to reveal a hidden extension leaf that is raised by momentarily applying an initiating downward force. The extension leaf raises itself to the same level as the sliding leaves are to form an extended tabletop. The extension leaf is moved down to its original level by an applied downward force and allows for the sliding leaves to be slid toward each other to form the unextended tabletop. Latching is accomplished by a latching pin. The first end of the latching pin is in a pin housing.

Applicant believes that another reference corresponds to U.S. Pat. No. 7,464,653 issued to Martin J. Dodge on Dec. 16, 2008 for Expansible table. However, it differs from the present invention because Dodge teaches a table comprising a table base having a table top, horizontally-fixed sections positioned atop the table base, and a plurality of self-storing expansion leaves that have at least a first length and a second length. The expansion leaves have a first length when stored within the table base and a second length when placed between the fixed sections. Double pivoting hinges connect the expansion leaves to the table base.

Applicant believes that another reference corresponds to U.S. Pat. No. 8,365,678 issued to Mario Morbidelli on Feb. 5, 2013 for Extensible table. However, it differs from the present invention because Morbidelli teaches an extensible table that includes: a main surface supported by a support base; a first auxiliary surface and a second auxiliary surface, arranged underneath the main surface when the table is retracted in a condition of minimum extension and coplanar and side by side to the main surface when the table is extended in the condition of maximum extension; and a table extension mechanism. The extension mechanism includes two movable supports arranged side by side, each carrying a respective auxiliary surface. The movable supports are supported and guided on the support base of the table for symmetrically and synchronously moving close and away the two auxiliary surfaces one with respect to the other during table extension and retraction movement. Each of the movable supports includes a lifting and lowering member of the respective auxiliary surface during the table extension and retraction movement.

Applicant believes that another reference corresponds to U.S. Pat. No. 8,550,011 issued to Shyi-Yueh Lee on Oct. 8, 2013 for Adjustable table. However, it differs from the present invention because Lee teaches an adjustable table having a base, a telescopic tube assembly, two outside tabletop components and two inside tabletop components. The base has at least one leg and a mounting bracket. The telescopic tube assembly has a shaft, a central tube and two sliding tubes. The shaft is located over the mounting bracket. The central tube is mounted securely around the shaft. The sliding tubes are mounted slidably around the shaft. The outside tabletop components are mounted slidably on the mounting bracket and are slidably mounted respectively on the sliding tubes. The inside tabletop components are foldable and each has a first board mounted pivotally and slidably on one sliding tube and a second board connected pivotally to the first board. Each inside tabletop component independently folds and flips underneath the outside tabletop components abut each other or abut one of the inside tabletop components to shorten a total tabletop length.

Applicant believes that another reference corresponds to U.S. Pat. No. 9,675,169 issued to Lai, et al. on Jun. 13, 2017 for Extendable table. However, it differs from the present invention because Lai, et al. teach an extendable table that includes a frame and a fixed board mounted on frame. The frame has two extension tubes arranged in parallel. The extension tube has an outer tube receiving two inner tubes therein. A gear wheel is provided on the outer tube and a gear rack is provided on each of the two inner tubes for engaging with the gear wheel, so that the two inner tubes move synchronously. The inner tube has an outer end thereof provided with a moving component. Two movable boards each have one side connected to the moving component and an opposite end laid on the fixed board. The movable boards may be drawn together to form a small tabletop or pulled apart to form, together with the fixed board, an extended tabletop. The inner tubes each have a lifting member that lifts the movable board for easy expanding/retracting operation.

Applicant believes that another reference corresponds to U.S. Pat. No. 9,907,393 issued to Luis Mario Rossi on Mar. 6, 2018 for Automated expandable table. However, it differs from the present invention because Rossi teaches an expandable table which allows to increase the tabletop surface remotely. The expandable table includes a plurality of primary leaves, a plurality of secondary leaves, a motorized actuation disk, and a guide disk. The motorized actuation disk is concentrically and rotatably connected to the guide disk in order to delineate a travel path for each of the primary leaves and each of the secondary leaves. The primary leaves and the secondary leaves are radially distributed about and operatively coupled to the motorized actuation disk and the guide disk. In a retracted configuration, the primary leaves make up the tabletop surface. In an expanded configuration, the primary leaves and the secondary leaves are positioned offset to a rotation axis of the motorized actuation disk with the secondary leaves being interspersed between the primary leaves.

Applicant believes that another reference corresponds to U.S. Pat. No. 9,924,791 issued to Bortolato, et al. on Mar. 27, 2018 for Expandable motorized table. However, it differs from the present invention because Bortolato, et al. teach a motorized expandable table that includes a vertical column upperly supporting a table top. In a first configuration the tabletop is defined only by main portions and in a second configuration only by the main portions and by additional portions, which include outer additional portions and a central additional portion. The additional portions are entirely covered by and hidden below the main portions in the first configuration, and the outer additional portions are disposed radially about a support associated with the column and present an inclination different from the adjacent outer additional portions. A driving system is associated with the main portions, the support, the outer additional portions and the central additional portion for their movement, to enable the table to pass between the first and the second configuration. An electronic control and management is provided for the driving system.

Applicant believes that another reference corresponds to U.S. Patent Application Publication No. 2004/0194672, published on Oct. 7, 2004 to Conley et al. for Expandable table. However, it differs from the present invention because Conley et al. teach an expanding table of the type in which a number of table top sections are caused to move outwardly and expand on rotation of the table top. The table top sections are coupled to a guide plate, which defines the positions between which the sections move. The guide plate is mounted for rotation and engages low friction rub blocks mounted along the inner perimeter of the outer edge of the table. The table top sections themselves are mounted on guides, which are at least partially received in the guide plate. Once the table top sections have been moved into the expanded configuration by rotation of the table top, table leaves are inserted in the spaces between adjacent table top sections to form a larger contiguous table surface.

Applicant believes that another reference corresponds to U.S. Patent Application Publication No. 2006/0032415, published on Feb. 16, 2006 to Ming-Cheng Wang for Slide assembly for extension table. However, it differs from the present invention because Wang teaches a pair of slide assemblies for use with an extension table. The slide assembly comprises an inner slide member secured to a left leaf and including a first roller sub-assembly provided at an inner end, an outer slide member secured to a right leaf and including a second roller sub-assembly provided at an inner end, and a main slide member secured to a body of the table and including a roller assembly provided at either end and a belt run through the roller assemblies and the first and the second sub-assemblies. Pulling the outer slide member rightward will move the inner slide member to the left as the belt conveys around the roller assembly.

Applicant believes that another reference corresponds to U.S. Patent Application Publication No. 2006/0075940, published on Apr. 13, 2006 to Martin J. Dodge for Expansible table. However, it differs from the present invention because Dodge teaches a table comprising a table base having a table top, horizontally-fixed sections positioned atop the table base, and a plurality of self-storing expansion leaves that have at least a first length and a second length. The expansion leaves have a first length when stored within the table base and a second length when placed between the fixed sections. Double pivoting hinges connect the expansion leaves to the table base.

Applicant believes that another reference corresponds to U.S. Patent Application Publication No. 2017/0127820, published on May 11, 2017 to Bortolato et al. for Expandable motorized table. However, it differs from the present invention because Bortolato, et al. teach a motorized expandable table includes a vertical column upperly supporting a table top. In a first configuration the table top is defined only by main portions and in a second configuration only by the main portions and by additional portions, which include outer additional portions and a central additional portion. The additional portions are entirely covered by and hidden below the main portions in the first configuration, the outer additional portions are disposed radially about a support associated with the column and present an inclination different from the adjacent outer additional portions. A driving system is associated with the main portions, the support, the outer additional portions and the central additional portion for their movement, to enable the table to pass between the first and the second configuration. The driving system has an electronic control and management.

Applicant believes that another reference corresponds to FR Pat. No. 2,734,133 issued to Dominique on Nov. 22, 1996 for Circular table top with radial segments enlarged leavers between them. However, it differs from the present invention because Dominique teaches a table having a circular top and a central leg and the top is made from identical radial segments. These have slides which move in rails on a support that is joined to the leg. The longitudinal axis of the rails is along the bisectors of the angle at the tip of each segment. To enlarge the top the segments are slid outwards and identical leaves are inserted between the segments. The inner ends of the leaves are pointed and they meet at the centre of the table.

Applicant believes that another reference corresponds to DE Pat. No. 3,603,614 issued to Reinhard Hoerlein on Aug. 13, 1987 for Extending table. However, it differs from the present invention because Hoerlein teaches extending tables equipped with two tabletop halves and one or two extension leaves. One or both tabletop halves can be selectively moved out, if they are of the appropriate design. In the case of a table with only one extension leaf, only both tabletop halves can be moved out. If both tabletop halves are to be moved out, by virtue of a geared coupling of the tabletop halves the second tabletop half is moved out as well when the first is pulled out manually. These extending tables has two main crossbeams, which are arranged at a distance from the outside of the outer frame corresponding to approximately one quarter of the width of the outer frame. For each tabletop half two guidebars are provided which are offset relative to one another such that one guidebar is guided on the inside on the main crossbeam and the other lies on the outer strips of the outer frame. A toothed strip is fastened to one guidebar of one tabletop half. If a table having two extension leaves is involved, two toothed wheels lying one above the other are provided, each toothed wheel being in engagement with a toothed strip of one tabletop half. The two toothed wheels can be coupled to one another by means of drivers when both tabletop halves are to be moved out.

Applicant believes that another reference corresponds to EP Pat. No. 1,815,767 issued to Brice on Aug. 8, 2007 for Pull out table and motorised mechanism for powering the extensions. However, it differs from the present invention because Brice teaches a table having an extension, and a fixed frame connected to feet of the table. A motorized driving mechanism has an electric actuator for driving the extension between a storage position and an usage position. The actuator has a rod connected with a lever by a hinged joint. A stop is connected to the frame, and the lever is stopped against the frame at the end of horizontal translation movement for lifting the extension through circular translation movement until the extension is locked against its edge.

Applicant believes that another reference corresponds to WO Patent No. 2016/005881 issued to Bortolato, et al. on Jan. 14, 2016 for Expandable motorized table. However, it differs from the present invention because Bortolato, et al. teach a motorized expandable table, comprising at least one vertical column upperly supporting a table top, when in a first configuration the table top is defined only by main portions, whereas when in a second configuration the table top is defined only by the main portions, and by additional portions; the additional portions comprise outer additional portions and a central additional portion, additional portions being entirely covered by and hidden below the main portions when in the first configuration; the outer additional portions are disposed radially about a support associated with the column, each outer additional portion being disposed, when in the first configuration, such as to present an inclination, defined with reference to the vertical column, which is different from the adjacent portions, driving means are provided associated with the main portions, with the support, with the outer additional portions and with the central additional portion for their movement, to enable the table to pass between the first and the second configuration, electronic control and management means are also provided for the driving means.

Other patents describing the closest subject matter provide for a number of more or less complicated features that fail to solve the problem in an efficient and economical way. None of these patents suggest the novel features of the present invention.

SUMMARY OF THE INVENTION

The present invention is a motorized extendable table, comprising a tabletop assembly, extension assemblies fixed on respective extension frame assemblies, a frame assembly fixedly mounted under the tabletop assembly, a motor housing, and a base assembly.

The motor housing houses a computer assembly and a motor assembly. The motor housing is mounted under the tabletop assembly within a space defined by the frame assembly. The computer assembly comprises a remote control. The base assembly comprises legs and is mounted onto the frame assembly.

The tabletop assembly comprises a tabletop with respective tabletop ends and tabletop edges. The extension assemblies comprise extension top faces having respective extension ends and extension distal ends.

The frame assembly comprises longitudinal rails, transversal frame members with respective stoppers, and ballbearing side slides. The ballbearing side slides are mounted within each end of respective longitudinal rails. The transversal frame members are leveled with a bottom wall of the longitudinal rails and the ends of the longitudinal rails receive the extension frame assemblies. Each of the extension frame assembly comprises lateral frame members having lateral frame member proximal ends, transversal frame members, and extension bars having extension bar proximal ends. The lateral frame member proximal ends are mounted onto respective ballbearing side slides within the longitudinal rails.

The extension bars have L-shaped defined by a bottom wall and a lateral wall. The lateral wall comprises double pivoting hinges. The extension bars are mounted onto an inner side of the lateral frame members, whereby the extension bars are hingedly mounted with the double pivoting hinges, and the lateral frame members are mounted onto the longitudinal rails.

The extension frame assemblies further comprise bridges transversally mounted, wherein the bridges comprise bridge ends that connect with respective extension bar proximal ends with extension bar stoppers.

The motor assembly comprises a motor, first and second sprockets, a chain, supporting blocks, first and second pulleys, and first and second switches. The first and second switches are disposed next to the first and second pulleys respectively.

The motor assembly further comprises a belt having first and second connectors, switch actuators, a third connector, and first and second extension rods having proximal ends and distal ends respectively. The chain is mounted onto the first and second sprocket. The supporting blocks hold the second sprocket. The belt is mounted onto the first and second pulleys and the first pulley is connected to the second sprocket.

The first connector is fixed to a lower portion of the belt, while a second connector is fixed to an upper portion of the belt at an opposite position with respect to the first connector. The third connector moves the switch actuators between two extreme positions of the first and second connectors.

The first and second extension rods extend from the first and second connectors respectively, whereby the proximal ends are fixed to respective first and second connectors, and the distal ends are fixed to respective transversal frame members.

The switch actuators actuate the first and second switches to stop the motor assembly to reach an extended configuration or a retracted configuration. In the retracted configuration, the extension assemblies are disposed under the tabletop assembly, and in the extended configuration, the extension assemblies are disposed on a same plane as said tabletop assembly.

It is therefore one of the main objects of the present invention to provide a motorized extendable table that can be operated and/or controlled with a remote control.

It is another object of this invention to provide a motorized extendable table that is volumetrically efficient for carrying, transporting, and storage.

It is another object of this invention to provide a motorized extendable table, which is of a durable and reliable construction.

It is yet another object of this invention to provide such a device that is inexpensive to maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
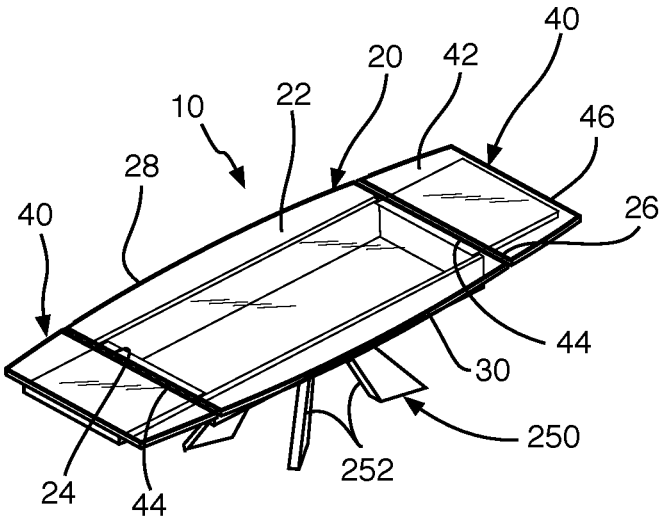
FIG. 1 represents an isometric view of a motorized extendable table in a fully extended configuration.

Referring now to the drawings, the present invention is generally referred to with numeral 10. It can be observed that it basically includes tabletop assembly 20, extension assemblies 40, frame assembly 70, extension frame assemblies 100, motor housing 160, computer assembly 180, motor assembly 200, and base assembly 250.

Figure 2:
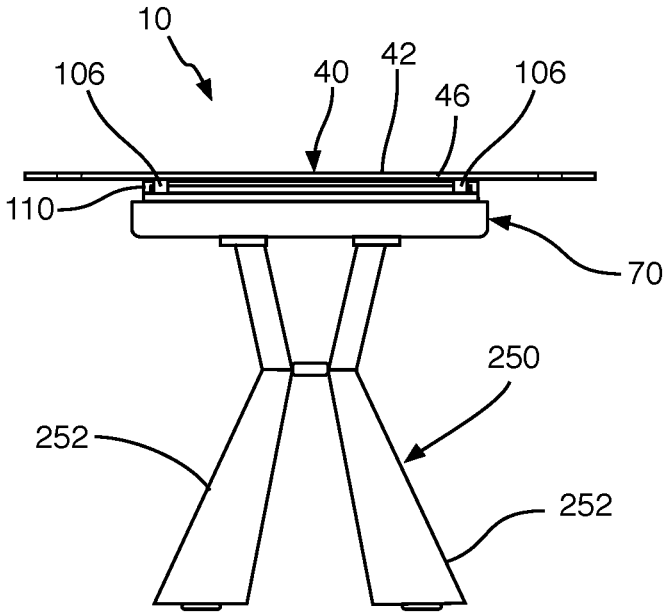
FIG. 2 is a longitudinal side view of the motorized extendable table in an intermediate extended configuration, wherein the extension bars are not fully extended.
Figure 3:
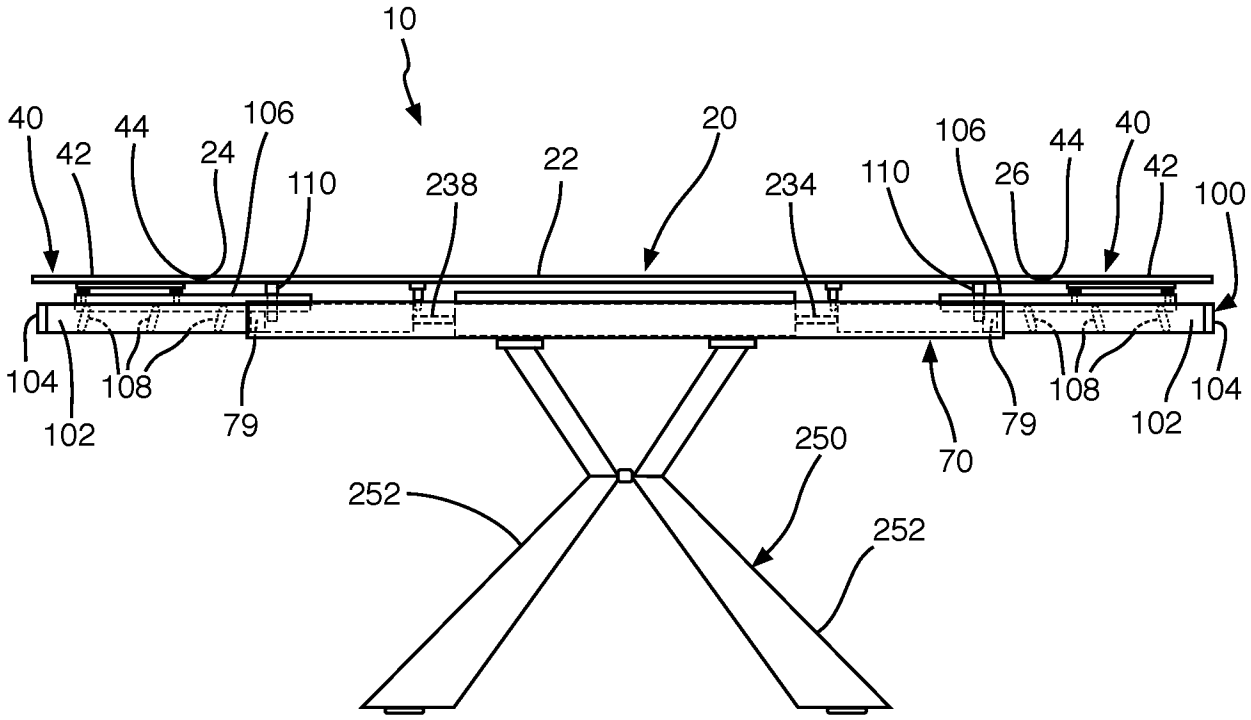
FIG. 3 is a transversal side view of the motorized extendable table in the intermediate extended configuration, wherein the extension bars are not fully extended.

As seen in FIGS. 1, 2, and 3, tabletop assembly 20 comprises tabletop 22 with tabletop ends 24 and 26. Tabletop 22 further comprises tabletop edges 28 and 30.

Extension assemblies 40 comprise extension top faces 42 having respective extension ends 44 and extension distal ends 46. In a retracted configuration, extension assemblies 40 are disposed under tabletop assembly 20. In an extended configuration, extension assemblies 40 are disposed on a same plane as that of tabletop assembly 20, in a way that extension ends 44 abut tabletop ends 24 and 26, respectively. Base assembly 250 is mounted to frame assembly 70. Base assembly 250 comprises legs 252. Frame assembly 70 is fixedly mounted under tabletop assembly 20.

As seen in FIG. 3, extension frame assembly 100 comprises extension bars 106. Extension bars 106 are hingedly mounted to lateral frame members 102 with double pivoting hinges 108. Extension assemblies 40 are fixed on respective extension frame assemblies 100.

Figure 4:
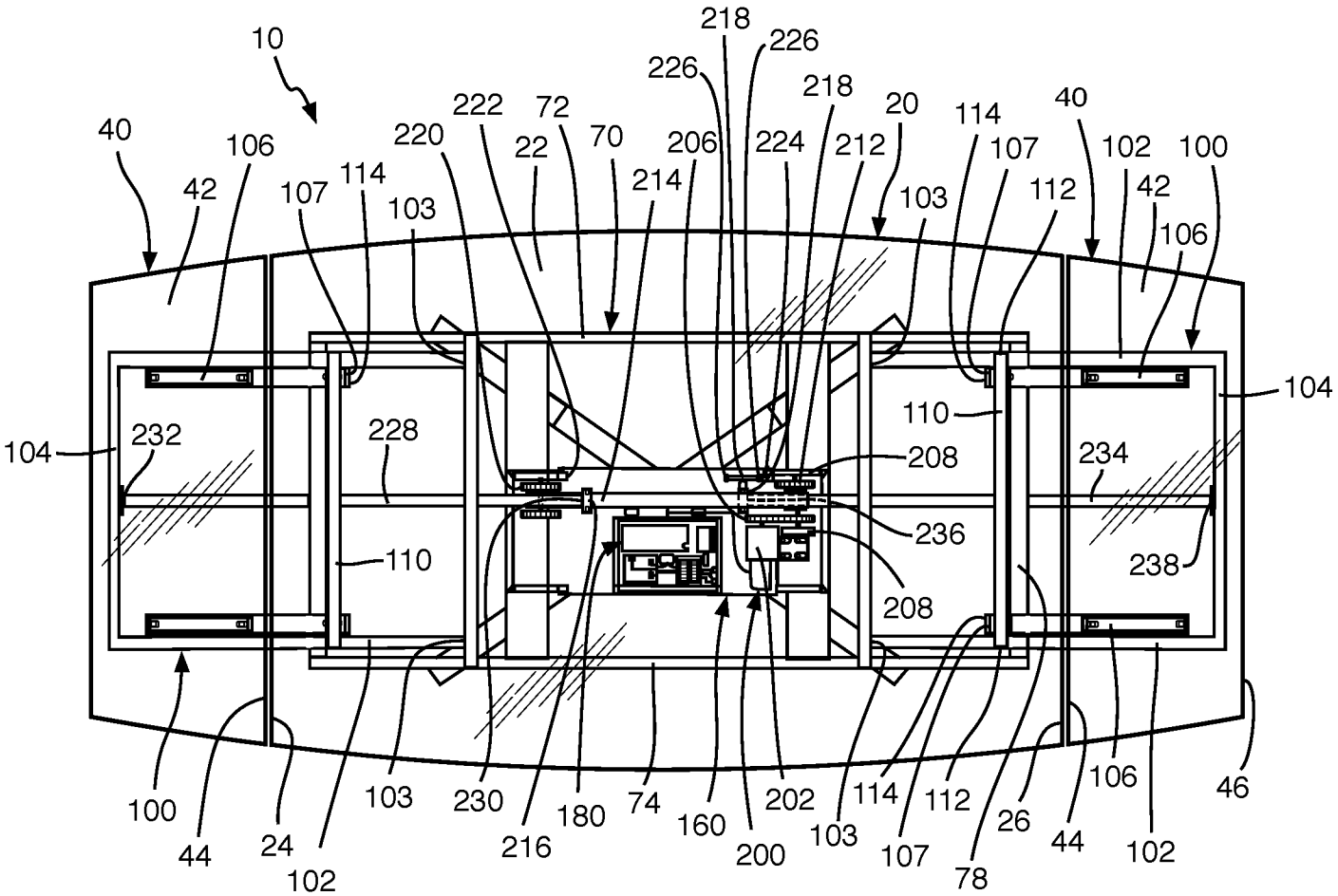
FIG. 4 is a top view of the invention in the fully extended configuration, illustrating the tabletop assembly and extension assemblies as transparent.
Figure 5:
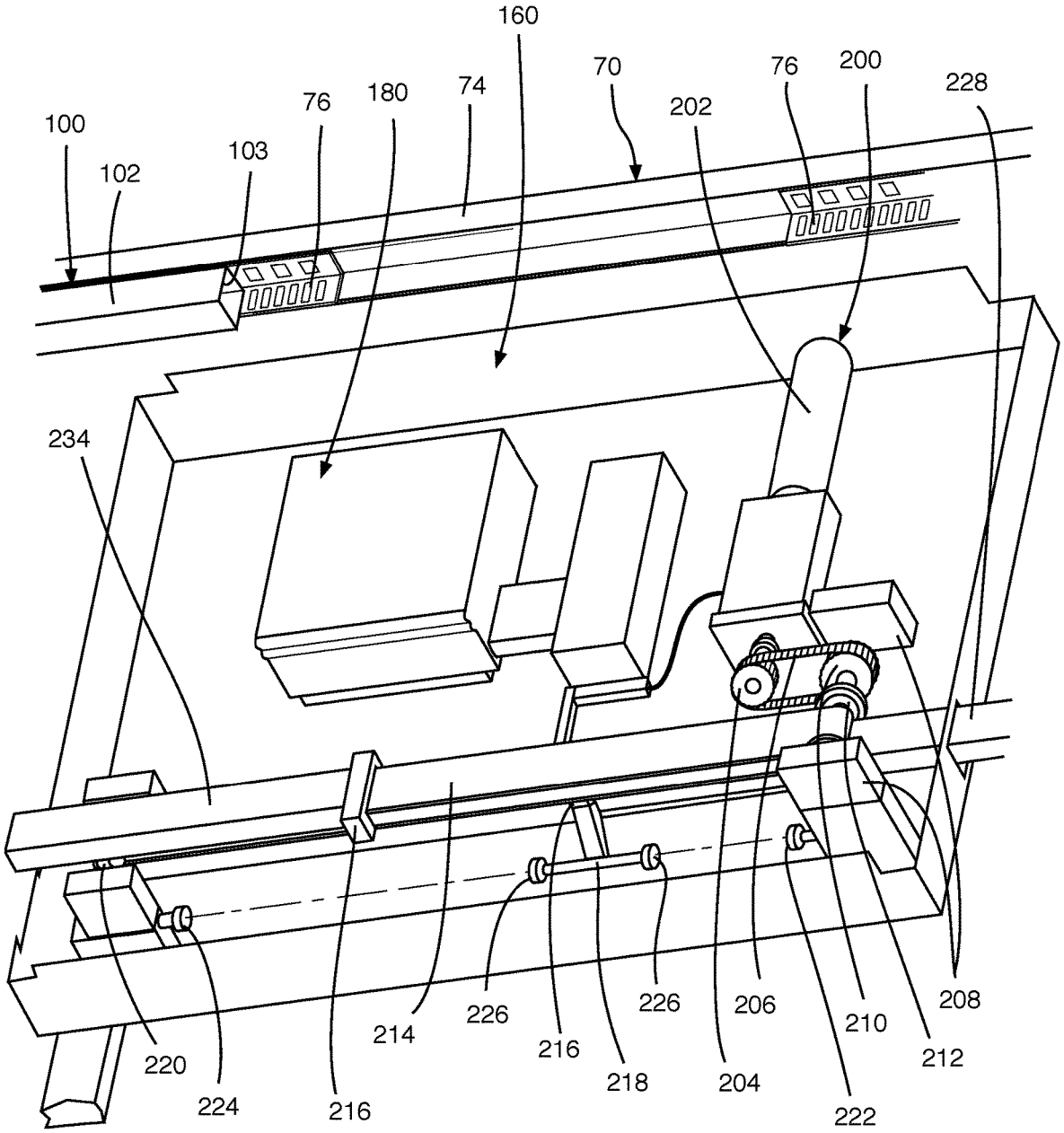
FIG. 5 is a partial top isometric view showing a motor assembly, a computer assembly, a frame assembly and extension frame assemblies.

As seen in FIGS. 3 and 4, in operation, belt 214 moves connectors 216, best seen in FIG. 5, causing extension rods 228 and 234 to move respective extension frame assemblies 100 from the retracted configuration to the extended configuration. At a predetermined distance before reaching the fully extended configuration, stoppers 79, stop extension bar stoppers 114 and therefore extension bars 106, while lateral frame members 102 continue moving. The movement of lateral frame members 102 cause a rotation of double pivoting hinges 108, urging extension bars 106 to raise/elevate, positioning extension top faces 42 at the same plane as that of tabletop assembly 20. The fully extended configuration is reached when switch actuator 226 actuates switch 224 to stop motor assembly 200. To go from the extended to the retracted configuration, motor assembly 200 is activated to move belt 214 in an opposite direction with respect to the direction described above. Thus, belt 214 moves connectors 216, best seen in FIG. 5, causing extension rods 228 and 234 to move extension frame assemblies 100 from the extended to the retracted configuration. At a predetermined distance, lateral frame members 102 go back. A weight of extension assemblies 40 makes double pivoting hinges 108 rotate back and extension bars 106 move downwardly, thus positioning extension top faces 42 to a lower plane. Extension frame assemblies 100 continue moving back until achieving the fully retracted configuration, reached when switch actuator 226 actuates switch 222 to stop motor assembly 200.

As seen in FIG. 4, bridges 110 are mounted transversally to extension frame assemblies 100. Bridges 110 have bridge ends 112. Specifically, bridge ends 112 connect extension bar proximal ends 107 of extension bars 106 with extension bar stoppers 114.

As seen in FIGS. 4 and 5, frame assembly 70 comprises longitudinal rails 72 and 74 and transversal frame members 78. Transversal frame members 78 are leveled with a bottom wall of longitudinal rails 72 and 74 in a way that ends of longitudinal rails 72 and 74 are free to receive extension frame assemblies 100. Transversal frame members 78 have stoppers 79, as shown in FIG. 3, at their ends. Ballbearing side slides 76 are mounted within each end of longitudinal rails 72 and 74.

Extension rod 228 has proximal end 230 and distal end 232. Extension rod 234 has proximal end 236 and distal end 238. Proximal end 230 of extension rod 228 is fixed to the first connector 216, and distal end 232 is fixed to a first transversal frame member 104. Proximal end 236 of extension rod 234 is fixed to a second connector 216 and distal end 238 is fixed to a second transversal frame member 104.

As seen in FIG. 5, motor housing 160 is mounted under tabletop assembly 20, seen in FIG. 1, within a space defined by frame assembly 70. Motor housing 160 houses computer assembly 180 and motor assembly 200 therein. Computer assembly 180 controls and electronically operates motor assembly 200. Computer assembly 180 comprises remote control 260 seen in FIG. 10.

Motor assembly 200 comprises motor 202 with sprocket 204 and chain 206 mounted thereto. Supporting blocks 208 hold sprocket 210 to which chain 206 is mounted too. Motor assembly 200 further comprises pulleys 212 and 220. Belt 214 is mounted to pulleys 212 and 220. Pulley 212 is connected to sprocket 210 with a shaft (not seen). Belt 214 has connectors 216. A first connector 216 is fixed to a lower portion of belt 214, while a second connector 216 is fixed to an upper portion of belt 214 at an opposite position with respect to the first connector 216. Motor assembly 200 further comprises connector 218, which moves switch actuators 226 between two extreme positions of connectors 216. Switches 222 and 224 are cooperatively disposed next to pulleys 212 and 220, respectively. Extension rods 228 and 234 extend from first and second connectors 216, respectively.

Figure 6:
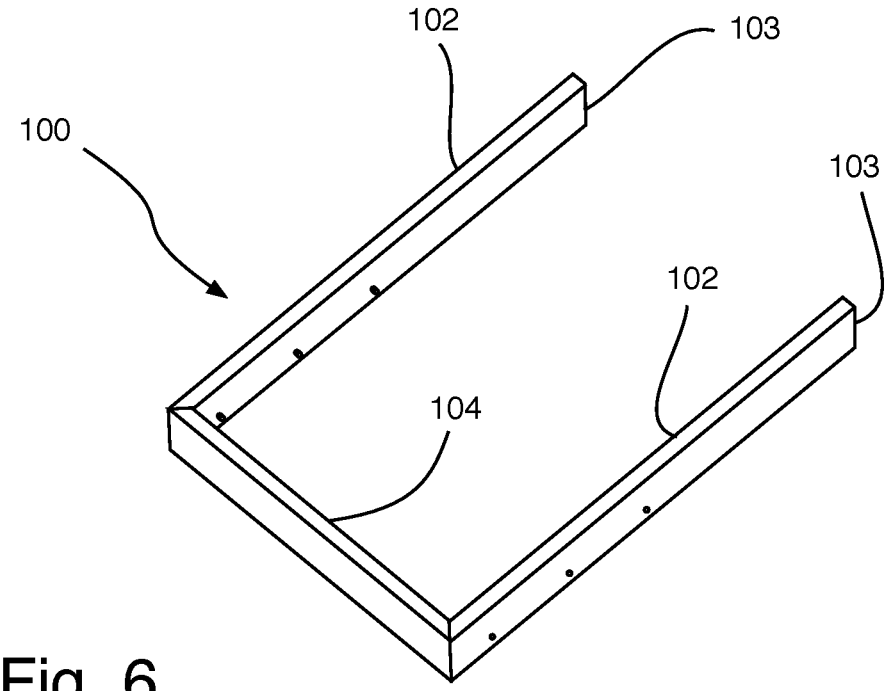
FIG. 6 is an isometric view of one extension frame assembly.

As seen in FIGS. 5 and 6, each extension frame assembly 100 comprises lateral frame members 102 and transversal frame members 104. Lateral frame members 102 have respective lateral frame member proximal ends 103. Lateral frame member proximal ends 103 are mounted to ballbearing side slides 76 and therefore within longitudinal rail 72, seen in FIG. 4, and longitudinal rail 74.

Figure 7:
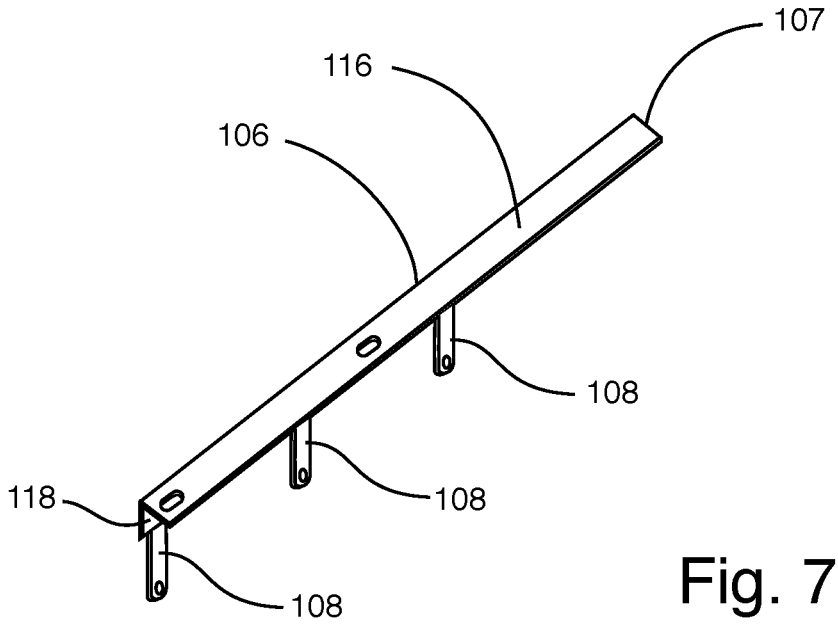
FIG. 7 is an isometric view of one extension bar.

As seen in FIG. 7, extension bars 106 have extension bar proximal ends 107. Extension bars 106 have L-shaped cross-sections defined by bottom wall 116 and lateral wall 118. Extension bars 106 have double pivoting hinges 108 mounted to lateral wall 118.

Figure 8:
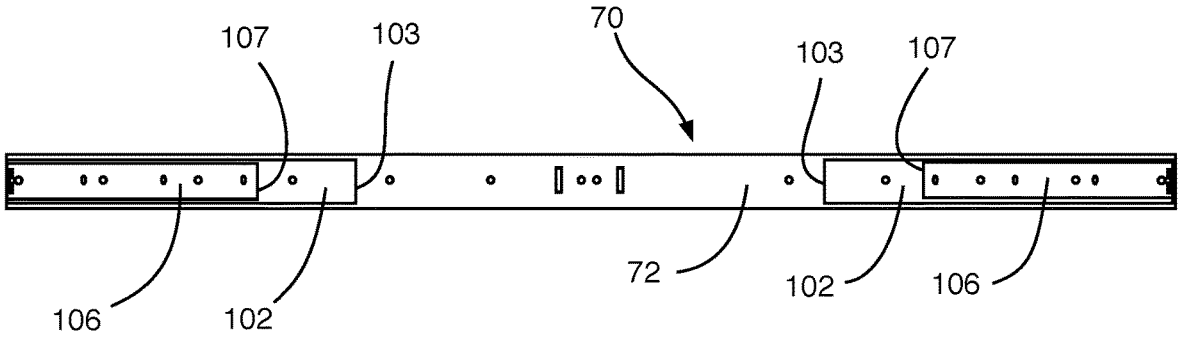
FIG. 8 is a longitudinal side view of the frame assembly with the extension lateral frame members and the extension bars mounted thereto.
Figure 9:
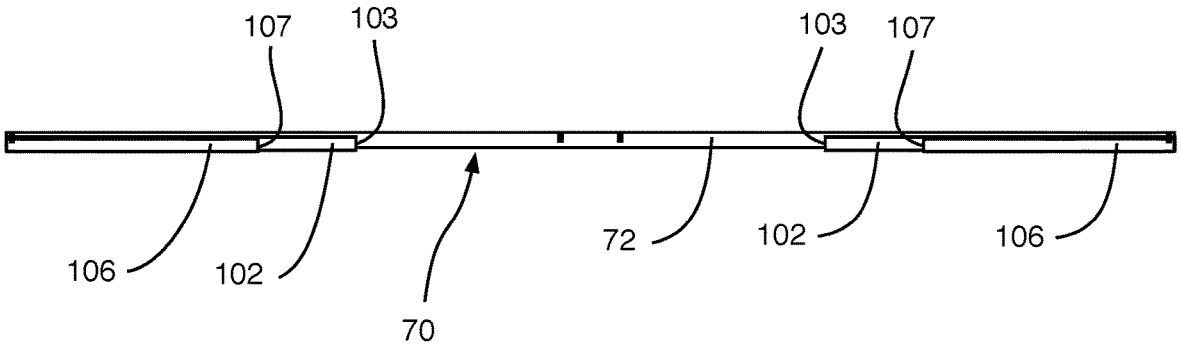
FIG. 9 is a top view of the frame assembly with the extension lateral frame members and the extension bars mounted thereto.

As seen in FIGS. 8 and 9, extension bars 106 are mounted to an inner side of lateral frame members 102. In turn, lateral frame members 102, are mounted to longitudinal rails 72 and 74, seen in FIG. 4.

Figure 10:
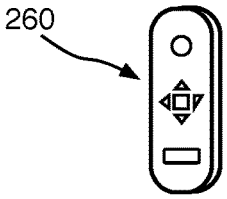
FIG. 10 is a front isometric view of a remote control of the present invention.

As seen in FIG. 10, present invention 10 further comprises remote control 260. Remote control 260 actuates motor assembly 200, seen in FIG. 5, place present invention 10 in the extended configuration and retracted configurations.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A motorized extendable table, comprising:

A) a tabletop assembly;

B) extension assemblies fixed on respective extension frame assemblies, each of said extension frame assembly comprises lateral frame members having lateral frame member proximal ends, transversal frame members, and extension bars having extension bar proximal ends, said extension bars having an L-shape defined by a bottom wall and a lateral wall, and said lateral wall comprises double pivoting hinges;

C) a frame assembly fixed under said tabletop assembly, said frame assembly comprises longitudinal rails, transversal frame members with respective stoppers, and ballbearing side slides, said ballbearing side slides are mounted within ends of respective said longitudinal rails;

D) a motor housing that houses a computer assembly and a motor assembly, said motor housing is mounted under said tabletop assembly within a space defined by said frame assembly;

E) a base assembly having legs, said base assembly is mounted onto said frame assembly.

2. The motorized extendable table set forth in claim 1, further characterized in that said tabletop assembly comprises a tabletop with respective tabletop ends and tabletop edges.

3. The motorized extendable table set forth in claim 1, further characterized in that said extension assemblies comprise extension top faces having respective extension ends and extension distal ends.

4. The motorized extendable table set forth in claim 1, further characterized in that said transversal frame members are leveled with a bottom wall of said longitudinal rails and said ends of said longitudinal rails receive said extension frame assemblies.

5. The motorized extendable table set forth in claim 1, further characterized in that said lateral frame member proximal ends are mounted onto respective said ballbearing side slides within said longitudinal rails.

6. The motorized extendable table set forth in claim 1, further characterized in that said extension bars are mounted onto an inner side of said lateral frame members, whereby said extension bars are hingedly mounted with said double pivoting hinges, and said lateral frame members are mounted onto said longitudinal rails.

7. The motorized extendable table set forth in claim 1, further characterized in that said extension frame assemblies further comprise bridges transversally mounted, wherein said bridges comprise bridge ends that connect with respective said extension bar proximal ends with extension bar stoppers.

8. The motorized extendable table set forth in claim 1, further characterized in that said motor assembly comprises a motor, first and second sprockets, a chain, supporting blocks, first and second pulleys, and first and second switches, said first and second switches are disposed next to said first and second pulleys respectively.

9. The motorized extendable table set forth in claim 8, further characterized in that said motor assembly further comprises a belt having first and second connectors, switch actuators, a third connector, and first and second extension rods having proximal ends and distal ends respectively.

10. The motorized extendable table set forth in claim 9, further characterized in that said belt is mounted onto said first and second pulleys, and said first pulley is connected to said second sprocket.

11. The motorized extendable table set forth in claim 9, further characterized in that said first connector is fixed to a lower portion of said belt, while a second connector is fixed to an upper portion of said belt at an opposite position with respect to said first connector.

12. The motorized extendable table set forth in claim 9, further characterized in that said third connector moves said switch actuators between two extreme positions of said first and second connectors.

13. The motorized extendable table set forth in claim 9, further characterized in that said first and second extension rods extend from said first and second connectors respectively, whereby said proximal ends are fixed to respective said first and second connectors, and said distal ends are fixed to respective said transversal frame members.

14. The motorized extendable table set forth in claim 9, further characterized in that said switch actuators actuate said first and second switches to stop said motor assembly to reach an extended configuration or a retracted configuration.

15. The motorized extendable table set forth in claim 14, further characterized in that, in said retracted configuration, said extension assemblies are disposed under said tabletop assembly, and in said extended configuration, said extension assemblies are disposed on a same plane as said tabletop assembly.

16. The motorized extendable table set forth in claim 8, further characterized in that said chain is mounted onto said first and second sprocket.

17. The motorized extendable table set forth in claim 8, further characterized in that said supporting blocks hold said second sprocket.

* * * * *